United States Patent [19]

Akiyama

[11] Patent Number: 4,545,184

[45] Date of Patent: Oct. 8, 1985

[54] APPARATUS FOR SUPPLYING BAGS OF PLIABLE OR EASILY FLEXIBLE NATURE

[76] Inventor: Shigeo Akiyama, No. 2519, Oaza Fujioka, Fujioka-cho, Shimotsuga-gun, Tochigi-ken, Japan

[21] Appl. No.: 500,817

[22] Filed: Jun. 3, 1983

[51] Int. Cl.[4] ..... B65B 43/36; B65H 9/06

[52] U.S. Cl. ..... 53/571; 53/386; 271/11; 271/243; 271/195

[58] Field of Search ..... 271/11, 12, 13, 195, 271/224, 229, 230, 231, 243; 53/69, 386, 468, 469, 564, 570, 571

[56] References Cited

U.S. PATENT DOCUMENTS

| | | | |
|---|---|---|---|
| 2,350,666 | 6/1944 | Allen | 53/386 |
| 3,934,388 | 1/1976 | Stadlbauer et al. | 53/571 |
| 4,006,002 | 2/1977 | Hetman | 271/243 |
| 4,373,319 | 2/1983 | Pullen et al. | 53/386 |

*Primary Examiner*—Bruce H. Stoner, Jr.
*Assistant Examiner*—James E. Barlow

[57] ABSTRACT

An apparatus for supplying bags of pliable or easily flexible material includes a vacuum mechanism for successively picking up the uppermost bag in a stack of the bags and transporting the same to a take-up roll mechanism. A delivering mechanism picks up the respective bag held by a holding mechanism at predetermined position and transports the same to the next processing station. The holding mechanism comprises an inclined holding plate having a stopper plate at the lower transverse edge so as to permit the respective bag received at the upper transverse edge to slide down along the upper surface of the holding plate until it is arrested by the stopper plate. An air discharge pipe extends longitudinally on the upper surface of the holding plate in the direction of transport of the bag. Air is discharged through a plurality of air discharge holes formed in the wall of the air discharge pipe between the upper surface of the holding plate and the bag sliding down the plate. This insures frictionless sliding action of the bag thereby positively preventing bending or change in presentation of the bag from occuring. Vacuum heads are located on the lower surface of the holding plate in alignment with openings formed in the holding plate so as to positively hold the bag on the upper surface of the holding plate at the predetermined position until the delivering mechanism is operated.

5 Claims, 3 Drawing Figures

APPARATUS FOR SUPPLYING BAGS OF PLIABLE OR EASILY FLEXIBLE NATURE

BACKGROUND OF THE INVENTION

The present invention relates to an apparatus for supplying bags of pliable or easily flexible nature and, more particularly to an apparatus for picking up one by one a bag of pliable or easily flexible nature such as a bag made of a thin snythetic resin film or a thin synthetic resin woven cloth from a lot of such bags located at a predetermined position and transporting the same to the next processing station located at another predetermined position.

In a prior art apparatus of the type described above, it has been difficult to transport the respective bag correctly without causing any bending or change in orientation of the bag, because the bag is very pliable and tends to generate frictional resistance and static electricity so that bending and change in orientation of the bag easily occur during the transport of the bag due to the frictional resistance and static electricity resisting against smooth movement of the bag.

SUMMARY OF THE INVENTION

The object of the present invention is to provide a novel and useful apparatus of the type described above which positively avoids the above described disadvantages of the prior art apparatus.

Another object is to provide an apparatus for picking up one by one a bag of pliable or easily flexible nature from a lot of such bags superposed each other and located at a predetermined position and transporting the same to the next processing station located at another predetermined position with the bag being held in regular or proper configuration and orientation without casusing any bending or change in orientation which might be caused due to the frictional resistance and static electricity generated during the transport of the bags.

The apparatus of the present invention is particularly adopted for use with bags having a rectangular bottom which is folded in the body of the bag in the flattened form before it is used in a filling machine.

The above object is achieved in accordance with the characteristic feature of the present invention by providing an apparatus having a vacuum sticking mechanism for successively picking up one by one by uppermost bag in a lot of the bags superposed with respect to each other and located at a predetermined position and transporting the same to another predetermined position, a take-out roll mechanism for successively receiving the respective bag transported to the above described another predetermined position and sending the same out of the take-out roll mechanism, a holding mechanism for successively receiving the respective bag sent out of the take-out roll mechanism and holding the same at a predetermined position, and a delivering mechanism for successively picking up the respective bag held at the predetermined position by the holding mechanism and transporting the same to the next processing station, characterized by the fact that the holding mechanism comprises an inclined holding plate having a stopper plate at the lower transverse edge thereof so as to permit the respective bag received at the upper transverse edge thereof from the take-out roll mechanism to slide down along the upper surface of the holding plate until it is arrested by the stopper plate so that the same is held at the predetermined position by the stopper plate, the holding plate being provided with an air discharge pipe extending longitudinally on the upper surface thereof substantially along its center line and adopted to discharge air through a plurality of air discharge holes formed in the cylindrical wall of the air discharge pipe thereby permitting the respective bag to slide down on the upper surface of the holding plate in the frictionless state by virtue of air discharged from the air discharge pipe into the space between the respective bag and the upper surface of the holding plate, while the holding plate is provided with vacuum sticking means located on the lower surface thereof at positions aligned with openings formed in the holding plate so as to positively hold the respective bag at the predetermined position determined by the stopper plate until the delivering mechanism is operated, so that the respective bag is positively prevented from being bent or changing its orientation during the time the respective bag is sliding down on the upper surface of the holding plate and arrested by the stopper plate until the delivering mechanism is operated.

With the above described apparatus of the present invention, the bag sliding down on the inclined holding plate is held in the floating state by virtue of air discharged into the space between the bag and the upper surface of the holding plate so that any frictional resistance and the static electricity tending to resist against the smooth sliding movement of the bag can be avoided, while the vacuum sticking means serve to positively hold the bag at the position arrested by the stopper plate so that the proper transport of the respective bag is insured.

In accordance with another characteristic feature of the present invention, at least the stopper plate is made reciprocally movable in the direction of transport of the respective bag between a first position upward from the lower end of the holding plate and a second position adjacent to the lower end of the holding plate where the bag arrested by the stopper plate can be properly picked up by the delivering mechanism, and an actuating mechanism is provided for reciprocally moving the stopper plate between the first position and the second position, the actuating mechanism being so operated that the movement of the stopper plate from the first position to the second position is commenced in synchronism with the reception of the respective bag at the upper transverse edge of the holding plate from the take-out roll mechanism so that the abutment of the respective bag sliding down on the upper surface of the holding plate against the stopper plate takes place before the stopper plate reaches the second position thereby insuring shock absorbing action to be given between the respective bag and the stopper plate, and the stopper plate is returned to the first position after the respective bag is picked up from the holding plate by the delivering mechanism.

Alternatively, the holding plate may be reciprocally moved together with the stopper plate wherein the holding plate is adopted to receive in its first position the respective bag at its upper transverse edge from the take-out roll mechanism and the bag is properly picked up at the second position of the holding plate by the delivering mechanism.

With the above described construction of the holding plate, the bag sliding down on the upper surface of the holding plate is positively prevented from being bent or from causing buckling thereof at the moment the bag abuts against the stopper plate for the reason described above.

DETAILED DESCRIPTION OF THE PREFERRED EMBODIMENT

Figure 1:
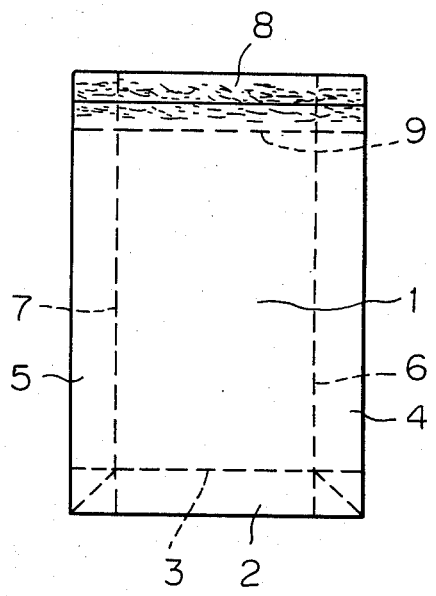
FIG. 1 is a view showing a bag of pliable or easily flexible nature to be handled by the apparatus of the present invention.

FIG. 1 shows an example of a bag 1 suitable for use with the apparatus of the present invention. The bag 1 is pliable or easily flexible and made of a thin synthetic resin film or a thin synthetic resin woven cloth. The bag 1 has a rectangular bottom 2 folded in the body of the bag 1 along the fold line 3 and right and left side walls 4, 5 each folded in the body of the bag 1 along the fold line 6, 7 so that the bag 1 is held in the flattened form before it is used in a filling machine. A heat sensitive or heat melting bonding agent 8 may be applied at appropriate portions on the inner surface and the outer surface adjacent to the open end of the bag 1 so that the bag 1, after filled with a content such as a material in the form of powder and granule, the open end is folded back onto the body of the bag 1 along the fold line 9 and heat is applied to the bonding agent 8 so as to sealingly close the open end.

Now, the apparatus of the present invention will be described with reference to FIGS. 2 and 3.

The apparatus consists of a supporting table 10 for supporting a lot of the bags 1 thereon, a vacuum sticking mechanism 11 for picking up one by one the uppermost bag 1 from the lot of the bags 1 supported on the table 10, a take-out roll mechanism 12 for receiving the bag 1 picked up by the vacuum sticking mechanism 11 and sending the same out of the take-out roll mechanism 12, and inclined holding mechanism 13 for receiving the bag 1 from the take-out roll mechanism 12 so that the bag 1 is gravitationally slid on the upper surface of the holding mechanism 13 until it is arrested at the predetermined position of the holding mechanism 13, and a delivering mechanism 14 for picking up the bag 1 held at the predetermined position on the holding mechanism 13 and transporting the same beneath a hopper 15 of a filling machine (not shown) well known in the art, where the bag 1 is transferred to opening expanding means such as vacuum operated expanding heads so that the opening of the bag 1 is engaged and tightened around the mouth of the hopper 15 so as to fill the bag 1 with a measured quantity of powdered or granular material from the hopper 15.

Since the filling machine and the vacuum operated expanding heads of the filling machine are well known in the art and not the subject of the present invention, detailed description thereof is not given here.

Supporting table

The supporting table 10 is supported by a lifting device (not shown) so that the level of the uppermost bag 1 of the lot supported by the table 10 is adjustably held constant in cooperation with a limit switch such as a limit switch 17. In order to limit the position of the right hand end, i.e. bottom side end 2 of the respective bag 1 of the lot, an arresting plate 18 having an arcuate end portion 18*a* is arranged at the right side of the table 10 and a swingable plate 19 is swingably connected at its left hand edge to the right hand edge of the table 10 by a shaft 20 secured to the table 10, the free end edge of the swingable plate 19 being closely adjacent to the arcuate portion 18*a* of the arresting plate 18. To this end, the center of the arcuate form of the portion 18*a* coincides with the axis of the shaft 20. The swingable plate 19 is connected to the free end of the piston rod 21*a* of a hydraulic cylinder 21 so that the level of the bottom side end 2 of the uppermost bag 1 in the lot which tends to be higher than the remaining portion of the uppermost bag 1 due to the thickened bottom side end of each bag 1 in the lot is adjusted to be horizontal by appropriately swinging the swingable plate 19 by the operation of the cylinder 21 in cooperation with a limit switch 22.

Vacuum sticking mechanism

The vacuum sticking mechanism 11 comprises a swingable supporting plate 23 swingably supported at its upper end by a shaft 24 stationarily held in the machine frame (not shown) so as to extend downwardly. A hydraulic cylinder 25 and pairs of guide rollers 26 are arranged on the supporting plate 23 as shown. A horizontal or transverse arm 27 is secured to the lower end of the piston rod of the cylinder 25 and a pair of guide rods 28 extending upwardly from the respective ends of the transverse arm 27 are guided by the pairs of guide rollers 26. A plurality of vacuum sticking heads 29 are mounted on the lower side of the transverse arm 27 at positions appropriately spaced from each other and a limit switch 30 is attached to the transverse arm 27 at the center thereof. A hydraulic cylinder 31 is swingably supported at its upper end by a shaft 32 secured to the machine frame and the free end of the piston rod 31*a* of the cylinder 31 is pivotally connected to the supporting plate 23. Thus the vacuum sticking heads 29 can be moved from the position upwardly spaced apart from the uppermost bag 1 of the lot as shown downwardly to abut against the uppermost bag 1 by the action of the cylinder 25 which is commenced by the operation of start button (not shown) so as to stick or catch the uppermost bag 1 by the vacuum sucking action of the heads 29 which is commenced by the action of the limit switch 30 actuated when the actuator thereof abuts against the uppermost bag 1, and, after the heads 29 are moved upwardly by the upward return stroke of the cylinder 25 which is commenced after a predetermined time period set by the delay time of a timer (not shown) with the uppermost bag 1 held stuck to the heads 29, the cylinder 31 is actuated upon detection of vacuum of the heads 29 by a vacuum switch (not shown) confirming the sticking of bag 1 to the heads 29 which causes the counterclockwise swinging movement of the supporting plate 23 together with the cylinder 25 thereby moving the heads 29 to the position shown by the broken line at which the bag 1 stuck to the heads 29 is transferred to the take-out roll mechanism 12 and the vacuum sucking action of the heads 29 is released. When the vacuum is not detected by the vacuum switch, the heads 29 are moved downwardly so as to catch a bag 1 again. After the bag 1 is transferred to the take-out roll mechanism 12, the cylinder 31 is actuated to return the vacuum sticking heads 29 to the position shown by the solid line.

Take-out roll mechanism

The take-out roll mechanism 12 comprises a driving roll 33 driven in the clockwise direction by a driving motor (not shown), a plurality of guide rolls 34 rollingly contacting around the periphery of the driving roll 33 so that the bag 1 received from the vacuum sticking mechanism 11 is moved around the driving roll 33 toward the direction obliquely downwards and rightwards as shown and transferred to the holding mechanism 13.

Holding mechanism

The inclined holding mechanism 13 comprises an inclined holding plate 35 extending in the direction in which the bag 1 is discharged from the take-out roll mechanism 12 and reciprocally movable in the direction of movement of the bag 1 by guide means (not shown) between a first position adjacent to the take-out roll mechanism 12 at which the bag 1 is received by the holding plate 35 and a second position remote from the take-out roll mechanism 12. To reciprocally move the holding plate 35, a hydraulic cylinder 36 is provided which is supported by the machine frame (not shown) and extending in parallel to the direction of movement of the holding plate 35. The outer end of the piston rod 36*a* of the cylinder 36 is secured to the lower end of the holding plate 35 so that the holding plate 35 is moved between the first position shown by the solid line and the second position shown by the broken line by the actuation of the cylinder 36.

The holding plate 35 is provided with a stopper plate 37 at its lower transverse edge so that the bag 1 received at the upper transverse edge of the holding plate 35 and gravitationally sliding down on the upper surface of the holding plate 35 is arrested by the stopper plate 37 and held at the position determined by the stopper plate 37. The holding plate 35 is formed with guide walls 35*a* at both side edges as shown in FIG. 3. However, the guide walls 35*a* are omitted in FIG. 2 for the simplicity of the showing.

In order to detect the reception of the bag 1 by the holding plate 35, a photoelectric detecting device 38 is arranged at the lower surface of the holding plate 35 is alignment with an opening (FIG. 3) formed in the holding plate 35. When the detecting device 38 detects the reception of the bag 1, the cylinder 36 is actuated so that the holding plate 35 commences downward movement from the first position toward the second position. This downward movement of the holding plate 35 serves to decrease the relative speed between the holding plate 35 and the bag 1 sliding down on the upper surface thereof, thereby permitting the shock occurring when the bag 1 abuts against the stopper plate 37 to be greatly reduced to hold the bag 1 in the regular configuration and orientation without causing any bending or buckling and change in orientation of the bag 1.

In order to correctly hold the bag 1 held at the position by the stopper plate 37, a photoelectric detecting device 39 is aligned with an opening 35*c* formed in the holding plate 35 above and between a pair of spaced vacuum sticking heads 40. Head 40 is aligned with one of the openings 35*d* formed in the holding plate 35 are arranged on the lower surface of the holding plate 35.

The detecting device 39 is located at a position closely above the upper edge of the bag 1 when the bag is received on the holding plate 35 and arrested by the stopper plate 37. Thus, when the bag 1 is advanced from the take-out roll mechanism 12 onto the holding plate 35, the leading edge of the bag 1 first intercepts a ray of light to be received by the detecting device 39. This causes a first signal to be generated which indicates to the detecting circuit of the detecting device 39 that it should be ready for detection of the proper positioning of the bag 1 on the holding plate 35. Just when the leading edge of the bag 1 reaches the stopper plate 37, (while the stopper plate is sliding downwardly on the holding plate 35), the device 39 by virtue of its location generates a second signal which indicates the proper positioning of the bag 1 on the holding plate 35 by the stopper plate 37. The vacuum sticking heads 40 are then actuated. After the actuation of the vacuum sticking heads 40, the detecting circuit is reset for the succeeding operation and the bag 1 is taken up by the delivering mechanism 14.

In order to detect the fact that the holding plate 35 reaches the second position after the bag 1 thereon has been arrested by the stopper plate 37 and held in the determined position by the vacuum heads 40 and actuate the delivering mechanism 14, a limit switch 41 is arranged at a position so as to sense that the holding plate 35 reaches the second position as shown. Thus, when the limit switch 41 is actuated, the delivering mechanism 14 is actuated so as to pick up the bag 1 held on the holding plate 35 located in the second position while the vacuum sticking heads 40 are rendered to be inoperative so that the bag 1 is brought to the hopper 15 by the delivering mechanism 14.

In accordance with the characteristic feature of the present invention, an air discharge pipe 41' is provided extending longitudinally on the upper surface of the holding plate 35 substantially along the center line thereof as shown. The air discharge pipe 41' is formed with a plurality of upper air discharge holes 41*a* and a plurality of side air discharge holes 41*b* through which air is discharged from the pipe 41' in the space between the upper surface of the holding plate 35 and the bag 1 sliding down thereon thereby permitting the bag 1 to be held in the floating state capable of effecting frictionless movement of the bag 1 so that the bag 1 is moved regularly without being subjected to any obstacle which might be caused by the frictional resistance and the static electricity occurring during the movement of the bag 1.

When the bag 1 is picked up by the delivering mechanism 14 from the holding plate 35 is described hereinafter, the detecting device 38 detects the removal of the bag 1 and actuates the cylinder 36 so that the holding plate 35 is moved upwardly to the first position.

In the above description, the holding plate 35 is described as being reciprocally moved together with the stopper plate 37. However, it is possible to reciprocally move only the stopper plate 37 while the holding plate 35 is held stationarily at the first position for achieving the same purpose.

Delivering mechanism

Figure 2:
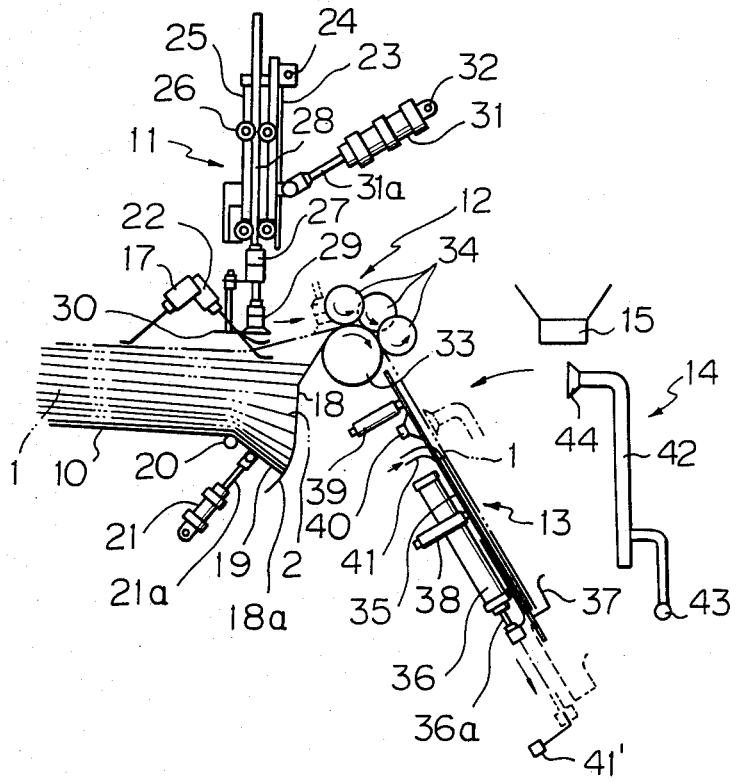
FIG. 2 is a schematic side view showing the main portions of the apparatus of the present invention.

The delivering mechanism 14 comprises a stem 42 supported at its lower end by driving means 43 schematically shown in FIG. 2 and a pair of vacuum sticking heads 44 (FIG. 3) mounted on the respective ends of a transverse arm 42*a* connected to the upper end of the stem 42.

Figure 3:
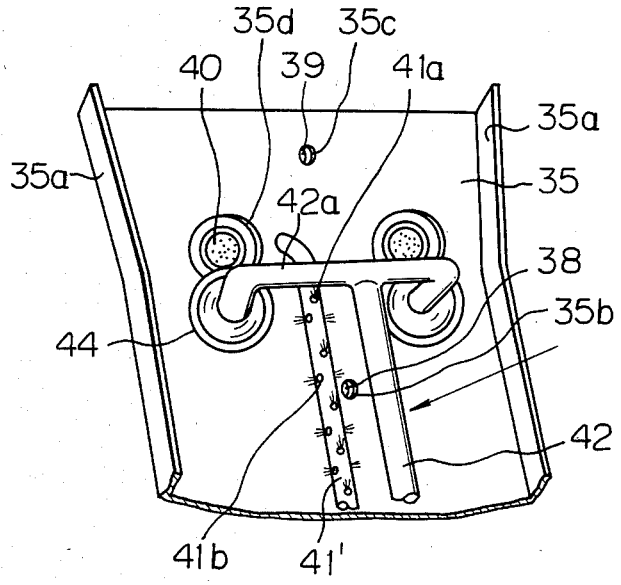
FIG. 3 is a fragmentary perspective view showing the air discharge pipe and vacuum sticking heads arranged in the holding plate of the present invention.

The stem 42 is swingable in the plane of FIG. 2 as well as movable in the direction perpendicular to the plane of FIG. 2 by the operation of the driving means 43 so that the vacuum sticking heads 44 can be moved to the position shown in FIG. 3 and by the chain line FIG. 2 where they pick up the bag 1 held on the holding plate 35 by the vacuum sucking action of the heads 44 while the vacuum sucking action of the heads 40 is released and, after they catch the bag 1, the heads 44 are moved to the position shown by the solid line in FIG. 2 and are moved in the direction perpendicular to the plane of FIG. 2 to the position beneath the hopper 15 of the filling machine where the bag 1 held by the heads 44 is transferred to the opening expanding heads (not shown) of the filling machine known in the art while the vacuum sucking action of the heads 44 is released. Thus, the opening of the bag 1 is tightened around the mouth of the hopper 15 by the opening expanding heads so as to be filled with measured quantity of powdered or granular material from the hopper 15.

Operation

The operation is clear from the above description.

In summary, when the vacuum sticking heads 29 are lowered together with the limit switch 30 by the action of the cylinder 25 so as to about against the uppermost bags 1 in the lot supported on the table 10, the limit switch 30 is actuated to supply vacuum to the heads 29 and then the heads 29 are moved upwardly together with the bag 1 stuck to the heads 29 by the action of the cylinder 25. As the bag 1 stuck to the heads 29 is moved upwardly, the limit switch 22 is actuated so that the cylinder 31 is actuated to swing the heads 29 toward the take-out roll mechanism 12 so that the bag 1 stuck to the heads 29 is transferred to the take-out roll mechanism 12 while the vacuum sucking action of the heads 29 is released.

When the bag 1 discharged from the take-out roll mechanism 12 is received on the upper surface of the holding plate 35, it slides down thereon by the action of gravity with the bag 1 being kept in floating state by air discharged from the air discharge pipe 41 to insure the frictionless movement of the bag 1 avoiding any obstacles which might be caused by the frictional resistance and the static electricity. When the detecting device 38 detects the reception of the bag 1 by the holding plate 35, the cylinder 36 is actuated to move the holding plate 35 downwardly so that the relative speed between the holding plate 35 and the bag 1 thereon is reduced so as to decrease the shock of abutment of the bag 1 against the stopper plate 37. When the bag 1 is held by the stopper plate 37, the detecting device 39 is actuated as has been previously set forth so as to supply vacuum to the vacuum sticking heads 40 to positively hold the bag 1 at the determined position on the holding plate 35. When the holding plate 35 reaches the second position after the bag 1 has been held by the heads 40, the limit switch 41 is actuated to actuate the delivering mechanism 14 while the vacuum sucking action of the heads 40 is released so that the bag 1 is picked up by the vacuum sticking heads 44 and brought to the hopper 15 where the bag 1 is transferred to the opening expanding heads of the filling machine so as to be filled with the material.

The apparatus of the present invention positively insures that the bag of pliable or easily flexible nature is held at all times in the regular configuration and orientation without being subjected to obstacles which might be caused by the frictional resistance and the static electricity during the movement of the bag.

In the foregoing description the control device and piping for supplying vacuum to the vacuum sticking heads are omitted. However, such is clearly understood by a person skilled in the art.

What is claimed is:

1. In an apparatus for supplying bags of pliable or easily flexible nature having a vacuum sticking mechanism for successively picking up one by one the uppermost bag in a lot of said bags superposed on each other and located at a predetermined position and transporting the same to another predetermined position, a take-out roll mechanism for successively receiving the respective bag transported to said another predetermined position and sending the same out of said take-out roll mechanism, a holding mechanism for successively receiving the respective bag sent out of said take-out roll mechanism and holding the same at a predetermined position, and a delivering mechanism for successively picking up the respective bag held at said predetermined position by said holding mechanism and transporting the same to the next processing station, the improvement being wherein said holding mechanism comprises an inclined holding plate having oppositely facing upper and lower surfaces and upper and lower transverse edges, a stopper plate at the lower transverse edge so as to permit the respective bag received at the upper transverse edge from said take-out roll mechanism to slide down along the upper surface of said holding plate until it is arrested by said stopper plate so that the same is held at said predetermined position by said stopper plate, said holding plate being provided with an air discharge pipe extending longitudinally on top of the upper surface thereof substantially along its center line and adopted to discharge air through a plurality of air discharges holes formed in the cylindrical wall of said air discharge pipe thereby permitting the respective bag to slide down on the upper surface of said holding plate in the frictionless state by virtue of air discharged form said air discharge pipe into the space between the respective bag and the upper surface of said holding plate, while said holding plate is provided with vacuum sticking means located on the lower surface thereof at positions aligned with openings formed in said holding plate so as to positively hold the respective bag at said predetermined position determined by said stopper plate until said delivering mechanism is operated.

2. Apparatus as set forth in claim 1, wherein said stopper plate is reciprocally movable in the direction of transport of the respective bag between a first position upward from the lower transverse edge of said holding plate and a second position adjacen to the lower edge of said holding plate where the bag arrested by said stopper plate can be properly picked up by said delivering mechanism, and an actuating mechanism is provided for reciprocally moving said stopper plate between said first position and said second position, the actuating mechanism being so operated that the movement of said stopper plate from said first position to said second position is commenced in synchronism with the reception of the respective bag on said holding plate from said take-out roll mechanism so that the abutment of the respective bag sliding down on the upper surface of said holding plate against said stopper plate takes place before said stopper plate reaches said second position thereby insuring shock absorbing action is given between the respective bag and said stopper plate, and said stopper plate is returned to said first position after the respective bag is picked up form said holding plate by said delivering mechanism.

3. Apparatus as set forth in claim 2, wherein said holding plate is reciprocally movable together with said stopper plate, said holding plate at said first position being adapted to receive at its upper transverse edge the respective bag from said take-out roll mechanism, while the respective bag is properly picked up by said delivering mechanism when said holding plate is held at said second position.

4. Apparatus for receiving a flexible plastic bag subsequent to removing the bag from a stack of bags and prior to filling the bag in a vertical direction, the apparatus comprising:

an inclined plate having an upper surface and lower surface and being positioned obliquely with respect to the vertical direction;

means for advancing the bag onto the upper surface of the plate;

means for displacing the the center of the bag with respect to the plate along the longitudinal extent of the bag so as to bow the bag, means for providing a cushion of air between the bag and the upper surface of the plate as the bag slides down the plate;

means for stopping the descent of the bag on the plate;

means for displacing the stopping means in the direction of movement of the bag down the plate;

sensing means for determining when a bag is moving down the plate, the sensing means initiating displacement of the stopping means, and first vacuum means on the plate for holding one side of the bag against the plate after the bag is positioned thereon.

5. The apparatus of claim 4 further including second vacuum means in opposed relation to the plate and movable toward and away from the plate to open the bag for filling of the bag.

* * * * *